United States Patent [19]

Williams

[11] Patent Number: 4,807,802

[45] Date of Patent: Feb. 28, 1989

[54] CONTAINER ASSEMBLY

[76] Inventor: Cole Williams, P.O. Box 1084, Glendale, Calif. 91209

[21] Appl. No.: 150,750

[22] Filed: Feb. 1, 1988

[51] Int. Cl.[4] ..... B65D 6/24

[52] U.S. Cl. ..... 229/23 R; 217/12 R; 217/65; 220/4 F; 229/8

[58] Field of Search ..... 229/23 R, 8; 220/4 F, 220/76; 217/12 R, 65; 446/69, 93, 94, 95

[56] References Cited

U.S. PATENT DOCUMENTS

| | | | |
|---|---|---|---|
| 1,923,881 | 8/1933 | Palais | 229/23 R |
| 1,924,709 | 8/1933 | Coulbeaux | 217/12 R |
| 2,615,589 | 10/1952 | Perdue | 217/12 R |
| 2,676,431 | 4/1954 | Goldberg | 229/8 |
| 3,109,420 | 11/1963 | Ott et al. | 220/4 F |
| 3,195,507 | 7/1965 | Miller | 217/12 R |
| 3,591,212 | 7/1971 | Rhyne | 217/65 |

FOREIGN PATENT DOCUMENTS

| | | | |
|---|---|---|---|
| 1180303 | 10/1964 | German Democratic Rep. | 220/4 F |
| 28023 | of 1909 | United Kingdom | 229/23 R |

*Primary Examiner*—Stephen Marcus
*Assistant Examiner*—Gary E. Elkins
*Attorney, Agent, or Firm*—James E. Brunton

[57] ABSTRACT

An erectable container assembly comprising end members, side members and a bottom member which are compactly packagable in a disassembled kit form for later assembly without the need for tools, separate fasteners, or adhesive to form a useful and decorative container. A combination of novel locking mechanisms are provided to permit quick and easy assembly of the container and to prevent accidental disassembly thereof.

9 Claims, 2 Drawing Sheets

CONTAINER ASSEMBLY

BACKGROUND OF THE INVENTION

1. Field of the Invention

The present invention relates generally to novelty containers or baskets. Specifically the apparatus of the present invention provides an erectable novelty container comprising end members, side members and a bottom member handle which are compactly packagable and can be assembled and interlocked together without tools, separate fasteners, or adhesive to form a useful and decorative container for storage and display of numerous types of small articles.

2. Discussion of the Prior Art

Containers similar to the present invention are often fabricated from wood or cardboard. The wooden containers are generally assembled with nails or adhesive to form a rigid structure. These types of containers are typically strong and durable. However, since fasteners such as nails or adhesive are used to construct the container it cannot be easily disassembled or reassembled.

The prior art cardboard containers are typically fabricated using interleaved cardboard flaps to maintain the structural integrity of the container. In some instances an adhesive is used to further strengthen the container. However, this type of construction also prevents easy disassembly of the container. Tape may also be used to add structural integrity to the container or prevent its accidental disassembly. Once again, the use of tape can cause substantial damage to the container during any attempted disassembly thereof

SUMMARY OF THE INVENTION

The present invention provides a novelty container which can be packaged, shipped, or stored in an unassembled condition. The apparatus comprises two end members, two side members and a bottom member which are interlocked together in a highly novel manner to form the desired structural shape.

Unlike most wooden containers, the present invention does not require nails, adhesive, or other fasteners for assembly. The end and bottom members of the apparatus contain specially configured slots, apertures and tabs which form part of the locking means of the invention. The sides are also slotted to receive hook shaped locking protuberances, or tabs, formed on the bottom member. When the end, side and bottom members are lockably interconnected, accidental disassembly of the container is positively prevented. Unlike the prior art basket constructions, the present invention may be readily disassembled by releasing the locking means provided on the various structural components. The basket of the invention may be assembled and disassembled numerous times without damage or degradation.

The containers of the present invention are vastly superior to prior art cardboard containers in many respects. The containers are more rigid than comparable prior art cardboard containers and can readily be assembled without the use of adhesives or tape. The containers may also be disassembled and reassembled without problems of structural damage, bending, and tearing which plague most cardboard containers in similar service.

It is an object of the invention to provide a container assembly which may be compactly packaged, stored, and shipped in the unassembled condition.

It is another object of the invention to provide a container assembly which may be easily assembled without special tools, adhesives, or other fasteners.

It is yet another object of the invention to provide a container as previously described which may be easily disassembled without damage when not in use and easily reassembled.

It is still another object of the invention to provide a container of the class described which can take various decorative forms such as that of a classic automobile.

DETAILED DESCRIPTION OF THE INVENTION

Figure 1:
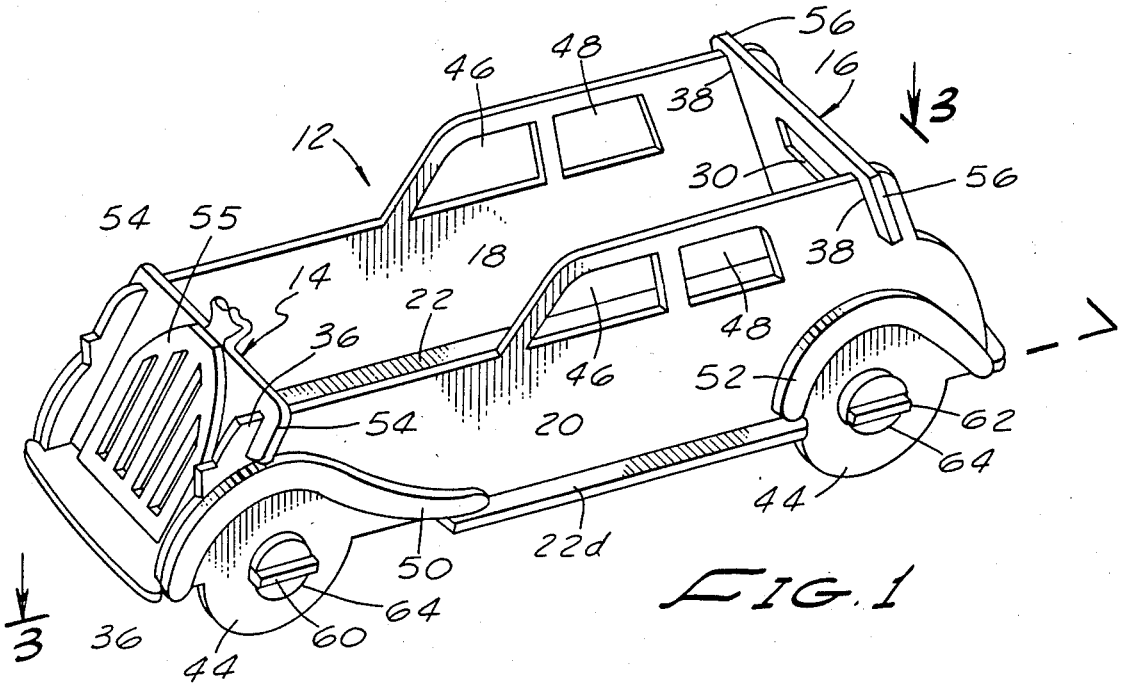
FIG. 1 is a generally perspective view of the assembled container of one form of the invention.
Figure 2:
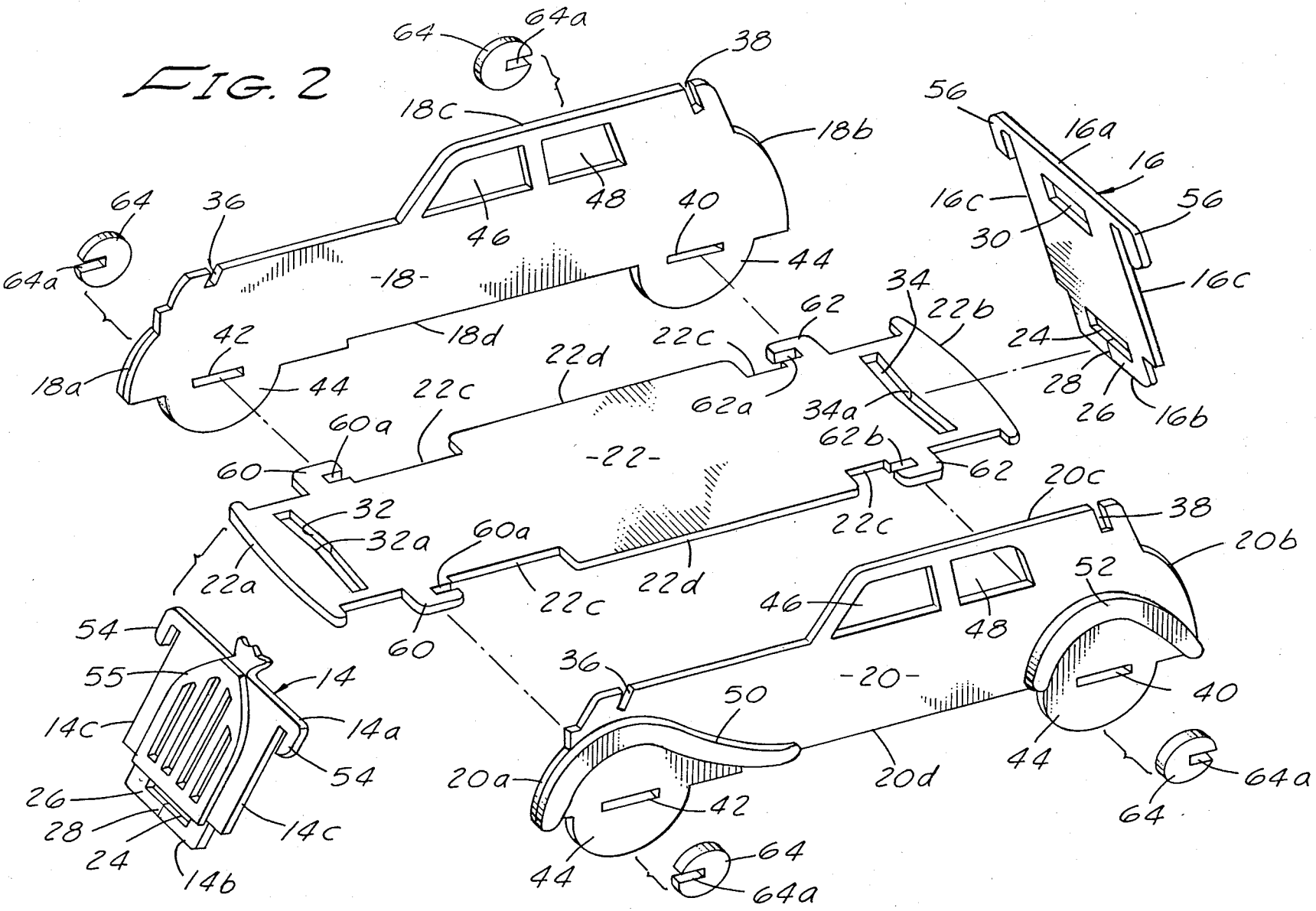
FIG. 2 is an exploded perspective view of the container shown in FIG. 1.

Referring to the drawings, and particularly to FIGS. 1 and 2, one form of the invention is thereshown. FIG. 1 shows the container assembly 12 in the assembled condition. Referring particularly to FIG. 2, an exploded view of the invention shows this embodiment of the invention to comprise two end members 14 and 16, two side members 18 and 20 and a planar bottom member 22. The end members 14 and 16 have transversely extending apertures 24 formed proximate their bottom portions. Beneath these apertures are transversely extending web portions 26, each of which is cut through by a centrally located cut 28.

Front end member 14 has top, bottom and side portions **14*a*, 14*b* and 14*c* respectively. Similarly, rear end member 16 has top, bottom and side portions 16*a*, 16*b* and 16*c* respectively. Previously identified web portion 26 of each member 14 and 16 is disposed between the lower margin of the member and the lower extremity of the transversely extending aperture 24. Rear end member 16 is also provided with a second transversely extending aperture 30** which, in this form of the invention, simulates the rear window of a vehicle of classic design.

Bottom member 22 is generally planar and includes front, rear and side portions **22*a*, 22*b* and 22*c* respectively. Forming an important aspect of the locking means of the present invention for releasably interconnecting the component part of the apparatus is the provision of a pair of longitudinally spaced, generally V-shaped apertures 32 and 34 formed in planar member 22. As best seen in FIG. 2, the apex portions 32*a* and 34*a* of apertures 32 and 34 extend inwardly toward the center portion of planar member 22. As will be described in greater detail hereinafter, apertures 32 and 34 form a part of the first locking means of this embodiment of the invention for releasably interconnecting the bottom portions 14*b* and 16*b* of the front and rear end members 14 and 16 with the bottom member 22**.

Side member 18 is provided with front, rear, top and bottom portions **18*a*, 18*b*, 18*c* and 18*d* respectively. Similarly, side member 20 is provided with front, rear, top and bottom portions 20*a*, 20*b*, 20*c* and 20*d*. Both side members 18 and 20** are generally planar shaped and each is provided with a downwardly extending first slot 36 in the top portion thereof located proximate the front portions 18*a* and 20*a* of the members (FIG. 2). Similarly, each of the side members is provided with a second slot 38 in the top portion thereof located proximate the rear portions 18*b* and 20*b* thereof. As will be discussed further hereinafter, slots 36 formed in the side members form a part of the second locking means of the invention for releasably interconnecting front end member 14 with side members 18 and 20. Slots 38, on the other hand, form a part of the third locking means of the invention for releasably connecting rear end member 16 with side members 18 and 20.

Each of side members 18 and 20 is also provided with an aperture 40 located proximate the bottom portion thereof near the rear portions 18*b* and 20*b* thereof. A similarly configured aperture 42 is provided in each of the side members proximate the bottom, front portions thereof. As indicated in FIG. 2, apertures 40 and 42 are longitudinally spaced and are disposed proximate the center of an arcuate shaped extension 44 which simulates the lower portion of the wheels of the automobile shaped container of the present form of the invention. These apertures 40 and 42 form a part of the fourth locking means of the invention for releasably interconnecting bottom member 22 with side members 18 and 20. To simulate the appearance of an automobile, each of the side members is suitable painted and lined and is also provided with apertures 46 and 48 which have the general shape of the windows of an automobile. Additionally, each of the side members 18 and 20 is provided with front and rear curved fender simulating members 50 and 52. Further, front end member 14 is provided with a member 55 having the appearance of an automobile grille and bottom member 22 includes running board simulating extensions 22*d*.

Forming another part of the second locking means of the present embodiment of the invention are transversely spaced hook-like members, or tabs, 54 provided on side portions 14*c* of front end member 14. As best seen by referring to FIGS. 1 and 3, front end member 14 is assembled with base or bottom member 22 and side members 18 and 20 by first inserting the web portion 26 of the front end member 14 into the V-shaped aperture 32 formed in bottom member 22. In inserting the web portion 26 of this member into aperture 32, the cut 28 facilitates deformation of the web portion 26 to permit its entrance into the V-shaped aperture. When the front end member 14 is snapped into the position shown in FIGS. 1 and 2, the apex portion 32*a* of the planar bottom member 22 will extend through the aperture 24 formed in the front end member 14 thereby securely locking the member 14 to the bottom member 22. As best seen by referring to FIG. 1, as web portion 26 of member 14 is inserted into the aperture 32, the hook-like protuberances 54 formed on member 14 will closely fit within slots 36 formed in each of the side members 18 and 20. With this interlocking configuration, front end member 14 will be securely positioned in an angularly, rearwardly extending orientation with side members 18 and 20 being supported in a substantially vertical orientation with respect to bottom member 22.

Forming another part of the third locking means of the invention are hook-like protuberances, or tabs, 56 which are formed on the side portions 16*c* of rear end member 16. When rear end member 16 is assembled with bottom member 22, web portion 26 of member 16 is inserted into V-shaped aperture 34 provided in base member 22. Once again, cut 26 facilitates the entrance of the web portion 26 into the aperture 34 and permits orientation of member 16 relative to bottom 22 such that the apex portion 34*a* of the bottom member will be received within transversely extending aperture 24 formed in rear end member 16. As web portion 26 of member 16 is inserted into aperture 34, hook-like protuberances 56 will mateably engage slots 38 formed in each of the side members and will function to releasably interconnect the end member 16 with the side portions. When the end member 16 is assembled in the manner shown in FIG. 1, the member will extend angularly forwardly of the apparatus and the rear portions of each of the side members will be maintained in a substantially vertical orientation with respect to bottom member 22.

Figure 3:
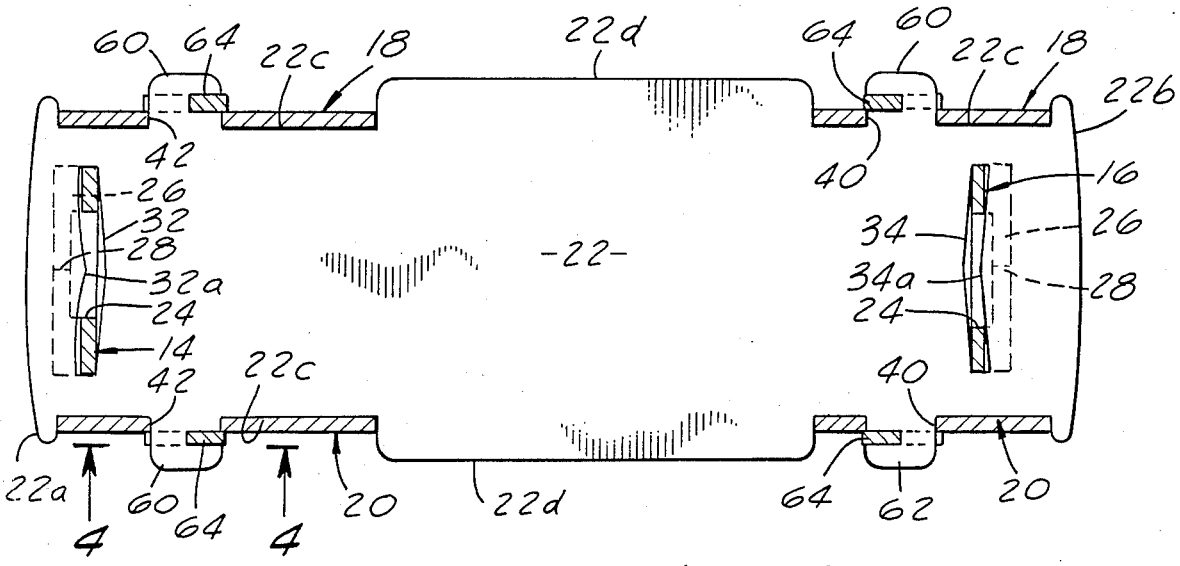
FIG. 3 is a cross-sectional view taken along lines 3—3 of FIG. 1.

Forming a part of the fourth locking means of the embodiment of the invention shown in the drawings are hook-like protuberances, or tabs, 60 and 62 provided on side portions 22*c* of bottom member 22. As best seen in FIG. 2, hook-like protuberances 60 are disposed proximate the forward end 22*a* of bottom member 22 while hook-like protuberances 62 are formed proximate rear portion 22*b* of the bottom member. Turning once again to FIGS. 1 and 3, it is to be observed that when the apparatus is in its assembled condition, hook-like members 60 are receivable within apertures 42 formed in the side members 18 and 20, while hook-like protuberances 62 are received within apertures 40 formed in the side members. As indicated in FIG. 3, when the bottom member 22 is thus assembled with the side members, the hook-like protuberances 60 and 62 extend through the side members a sufficient distance so that slot portions 60*a* and 62*a* of the hook-like protuberances protrude past the plane defined by the outside surfaces of the side members 18 and 20.

Figure 4:
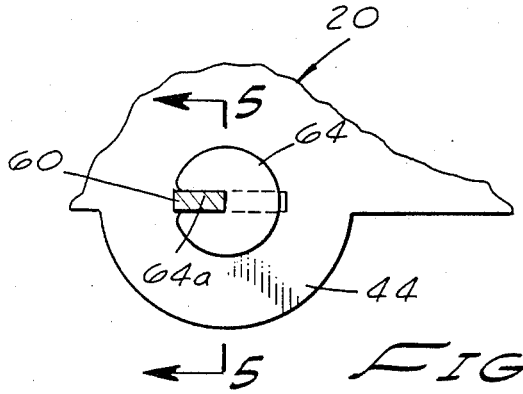
FIG. 4 is a fragmentary cross-sectional view taken along lines 4—4 of FIG. 3.
Figure 5:
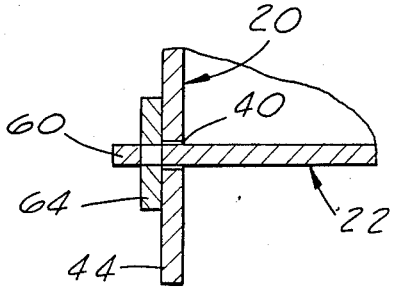
FIG. 5 is a cross-sectional view taken along lines 5—5 of FIG. 4.

Forming yet another part of the fourth locking means of the present embodiment of the invention are four generally circular shaped locking members 64. Each of these locking members 64 is intended to have the appearance of an automobile hub-cap and is provided with a radially extending slot 64*a*. As best seen in FIGS. 4 and 5, slots 64*a* are closely receivable over hook-like protuberances 60 and 62 formed on bottom member 22 in a manner such that members 64, when in an interlocked position, prevent withdrawal of the hook-like protuberances from the apertures 40 and 42 formed in the side members 18 and 20.

In assembling the apparatus of the invention of the configuration shown in FIG. 1, hook-like protuberances or tabs 60 and 62 are first inserted into apertures 40 and 42 formed in the side members 18 and 20. Next, front end member 14 is positioned relative to base 22 so that web portion 26 extends through V-shaped aperture 32. Because of the V-shaped configuration of aperture 32 and the cut 28 formed in the web portion 26, as the front end member 14 is mated with the bottom member 22 it will tend to snap into locked position within the bottom member. Next, the back end member 16 is similarly mated with bottom member 22 by inserting web portion 26 into V-shaped slot 34. During interconnection of the end members with the bottom member, hook-like protuberances 54 are mated with slots 36 formed in the side members and hook-like protuberances 56 are mated with slots 38 formed in the rearward portion of side members 18 and 20. Finally, locking members 64, which simulate the hubcaps of the vehicle, are mated with the outwardly protruding hook-like protuberances 60 and 62 formed on the bottom member thereby releasably interlocking the bottom portion of side members 18 and 20 with the side portions 22c of bottom member 22.

With the apparatus in the assembled configuration shown in FIG. 1, the apparatus simulates the appearance of a classic automobile and provides an article receiving area disposed intermediate sides 18 and 20 and above bottom 22. Within this enclosed area a multitude cf different types of small items can be carried and displayed.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A container assembly comprising:

(a) front and rear end members each having top, bottom and side portions;

(b) a generally planar bottom member having front, rear and side portions and being provided with a pair of longitudinally spaced, generally "V" shaped apertures;

(c) first locking means for releasably interconnecting said bottom portions of said front and rear end members with said bottom member;

(d) a pair of side members each having front, rear, top and bottom portions;

(e) second locking means for releasably interconnecting said front end member with said side members;

(f) third locking means for releasably interconnecting said rear end member with said side members, and (g) fourth locking means for releasably interconnecting said bottom member with sad side members.

2. A container assembly as defined in claim 1 in which each of said front and rear end members is provided with a transversely extending aperture provided proximate said bottom portions thereof, said bottom portions of each of said front and rear end members being receivable within one of the generally "V" shaped apertures formed in said bottom member whereby a portion of said bottom member extends through said transversely extending apertures provided in said front and rear end members.

3. A container assembly as defined in claim 1 in which each of said side members is provided with a first slot in said top portion proximate said front portion thereof, and in which said second locking means comprises hook-like protuberances provided on said side portions of said front end member, said hook-like protuberances being receivable within said first slots provided in said side portions.

4. A container assembly as defined in claim 1 in which each of said side members is provided with a second slot in said top portion proximate said rear portion thereof and in which said third locking means comprises hook-like protuberances provided on said portions of said rear end member, said hook-like protuberances being receivable within said second slots provided in said side portions.

5. A container assembly as defined in claim 1 in which each of said side members is provided with a pair of longitudinally spaced apertures disposed proximate the bottom portion thereof and in which said fourth locking means comprises longitudinally spaced hook-like protuberances formed proximate said side portion of said bottom member, said hook-like protuberances being receivable with said longitudinally spaced apertures provided in said side members.

6. A container assembly as defined in claim 5 in which said fourth locking means further comprises four locking members each said member having a slot receivable over one of said longitudinally spaced hook-like protuberances formed proximate said side portions of said bottom member.

7. A transport container assembly comprising:

(a) front and rear end members having top, bottom and side portions, each member having transversely extending apertures disposed proximate said bottom portions of said members and hook-like protuberances formed proximate each said side portion thereof;

(b) a bottom member having front, rear and side portions, said bottom member being provided with longitudinally spaced, transversely extending generally "V" shaped apertures for receiving the bottom portions of said end members, said bottom member further having a pair of longitudinally spaced hook-like protuberances provided on each said side portion thereof;

(c) two side members having front, rear, top and bottom portions each said side member having:

(i) a first slot formed in said top portion proximate said rear portion thereof for receiving one of said hook-like protuberances formed on said rear end member;

(ii) a second slot formed in said top portion proximate said front portion thereof for receiving one of said hook-like protuberances formed on said front end member;

(iii) an aperture in said bottom portion proximate said rear portion for receiving one of said hook-like protuberances formed on said bottom member; and (iv) an aperture formed in said bottom portion proximate said front portion for receiving one of said hook-like protuberances formed on said bottom member; and (d) means for holding said hook-like protuberances formed on said bottom member within said third and fourth slots formed in said side members.

8. A container assembly as defined in claim 7 in which the transversely extending apertures formed in said front and rear end members are located so that a portion of said bottom member extends therethrough when said bottom portions of said end members are received within the generally "V" shaped apertures formed in said bottom member.

9. A container assembly as defined in claim 7 in which said means for holding said hook-like protuberances comprise generally disc shaped elements each having a radially extending slot formed therein.

* * * * *